US010138888B2

(12) United States Patent
Ott et al.

(10) Patent No.: US 10,138,888 B2
(45) Date of Patent: Nov. 27, 2018

(54) PLASTIC ROTOR FOR A VACUUM PUMP

(71) Applicant: Joma-Polytec GmbH, Bodelshausen (DE)

(72) Inventors: Hans-Peter Ott, Hirrlingen (DE); Bernd Hess, Nuertingen (DE); Martin Thoma, Riederich (DE); Thomas Gulde, Hechingen (DE); Torsten Helle, Dusslingen (DE); Freidhelm Pfitzer, Rangendingen (DE)

(73) Assignee: Joma-Polytec GmbH, Bodelshausen (DE)

( * ) Notice: Subject to any disclaimer, the term of this patent is extended or adjusted under 35 U.S.C. 154(b) by 108 days.

(21) Appl. No.: 15/207,887

(22) Filed: Jul. 12, 2016

(65) Prior Publication Data

US 2017/0016445 A1 Jan. 19, 2017

(30) Foreign Application Priority Data

Jul. 13, 2015 (DE) ..... 10 2015 213 099

(51) Int. Cl.

| | |
|---|---|
| ***F03C 2/00*** | (2006.01) |
| ***F03C 4/00*** | (2006.01) |
| ***F04C 15/00*** | (2006.01) |
| ***F04C 18/344*** | (2006.01) |
| ***F01C 21/08*** | (2006.01) |

(Continued)

(52) U.S. Cl.

CPC ..... *F04C 18/3448* (2013.01); *F01C 21/0809* (2013.01); *F04C 18/344* (2013.01); *F04C 25/02* (2013.01); *F04C 29/005* (2013.01); *F04C 29/0071* (2013.01); *F04C 2240/20* (2013.01); *F04C 2240/40* (2013.01); *F05C 2225/00* (2013.01)

(58) Field of Classification Search

CPC .... F04C 18/344; F04C 18/3448; F04C 25/02; F04C 29/005; F04C 29/0071; F04C 2240/20; F04C 2240/40; F05C 2225/00; F01C 21/0809

USPC ..... 418/259, 178–179, 152

See application file for complete search history.

(56) References Cited

U.S. PATENT DOCUMENTS

| | | | |
|---|---|---|---|
| 4,384,828 A | 5/1983 | Rembold et al. | |
| 2010/0119396 A1 | 5/2010 | Gua | |

FOREIGN PATENT DOCUMENTS

| | | | |
|---|---|---|---|
| DE | 3150569 A1 | 6/1983 | |
| DE | 102008054240 A1 | 7/2009 | |
| DE | 102012210048 A1 * | 12/2013 | ..... F01C 21/0827 |

(Continued)

OTHER PUBLICATIONS

EP 16173480 European Search Report dated Nov. 23, 2016.

*Primary Examiner* — Theresa Trieu

(74) *Attorney, Agent, or Firm* — Pearne & Gordon LLP

(57) ABSTRACT

A rotor for a vane cell pump—in particular, for a vacuum pump—with a base body that is made of plastic and can be driven by rotation, and that rotates about an axis of rotation during operation, wherein the base body comprises a guiding section for slidably receiving a pump vane and wherein the base body is flanked in the direction of the axis of rotation by a first bearing surface and a second bearing surface, wherein the second bearing surface comprises bearing sections that are at a distance from one another and that lie on a circular path that is arranged concentrically to the axis of rotation.

14 Claims, 4 Drawing Sheets

(51) Int. Cl.
*F04C 25/02* (2006.01)
*F04C 29/00* (2006.01)

(56) References Cited

FOREIGN PATENT DOCUMENTS

| | | | |
|---|---|---|---|
| EP | 0933532 | A2 | 8/1999 |
| WO | 03036094 | A2 | 1/2003 |
| WO | 2004083604 | A1 | 9/2004 |
| WO | 2012056295 | A2 | 5/2012 |

* cited by examiner

PLASTIC ROTOR FOR A VACUUM PUMP

CROSS-REFERENCE TO RELATED APPLICATION

This application claims the benefit of German Patent Application No. 10 2015 213 099.1 filed Jul. 13, 2015, the entire disclosure of which is incorporated herein by reference.

BACKGROUND

The invention relates to a rotor for a vane cell pump—in particular, for a vacuum pump—with a base body that is made of plastic and can be driven by rotation, and that rotates about an axis of rotation during operation, wherein the base body comprises a guiding section for slidably receiving a pump vane and wherein the base body is flanked in the direction of the axis of rotation by a first bearing surface and a second bearing surface. The invention further relates to a vane cell pump—in particular, a vacuum pump—comprising such a rotor.

Rotors for vane cell pumps are widely known from the prior art. Such rotors typically comprise a circular cylindrical guiding section with at least one vane shaft for slidably accepting a pump vane, wherein, on both sides of the guiding section, circular cylindrical bearing surfaces are respectively provided that are accommodated in appropriately corresponding bearing recesses of a pump housing, so that the rotor is rotatably mounted in the pump housing. In the region of the guiding section, such rotors have a larger outer diameter than in the region of the bearing surfaces, so that between the guiding section and the bearing surfaces, a shaft shoulder is provided that can also be used as a stop in the bearing recesses of the pump housing. Such a rotor is known from DE 10 2012 210 048 A1, for example.

Rotors for vane cell pumps are often made of metal, wherein these rotors are cast with lost molds. Furthermore, it is, however, also known to produce rotors for vane cell pumps using the plastic injection molding process. For these rotors made of plastic, it has, however, been shown that a solid construction of the base bodies of the rotors can result in the formation of blowholes. In order to avoid the formation of blowholes, it is known from the prior art to provide recesses in the base body in the circular ring-shaped shaft shoulder of the guiding section, which has a larger diameter than the bearing surfaces. Such recesses can, however, only be realized in comparatively short rotors with a comparatively large diameter or a comparatively large shaft shoulder. In comparatively long rotors with a comparatively small diameter, this approach is, however, problematic, since the differences between the diameters of the guiding section and the bearing surfaces are not suitable for the formation of sufficiently large recesses.

BRIEF SUMMARY

The invention therefore has the aim of providing a plastic rotor for a vane cell pump—in particular, for a vacuum pump—in which the formation of blowholes can be easily and reliably prevented.

A rotor is characterized in that the second bearing surface comprises bearing sections that are at a distance from one another and that lie on a circular path that is arranged concentrically to the axis of rotation. This segmented design of the second bearing surface has been proven to be particularly advantageous, since an arrangement of recesses is made possible not just in the region of the circular ring-shaped shaft shoulder.

It is, therefore, particularly preferred if the base body comprises recesses that start from the second bearing surface and extend along the axis of rotation. Preferably, the recesses are designed to be cylindrical or nearly cylindrical in such a way that an injection molding tool can easily be formed. It has further been proven to be of particular advantageous if the recesses extend radially into the second bearing surface. As is customary, the base body of the rotor comprises, in the region of the guiding section, a vane shaft in which a vane can be slidably received between two planes, wherein the guiding section is preferably designed to be circular cylindrical.

Advantageously, the second bearing surface comprises two circular arc sections that are radially opposite each other and that each comprise a bearing section radially at the outside. In this respect, it is particularly preferred if each of the circular arc sections is limited by two planes arranged in parallel to the vane shaft of the guiding section and by the bearing sections arranged concentrically to the circular path.

It is, furthermore, advantageous if the second bearing surface comprises between the circular arc sections at least one—preferably, two—bar sections that comprise a bearing section at their free ends. By providing bar sections that are arranged between the circular arc sections, a further radial guidance of the second bearing surface is made possible in addition to the bearing sections of the circular arc sections, wherein larger recesses can be provided between the bars.

In another advantageous development of the rotor, it is provided that the second bearing surface is designed to be cylindrical. Since the bearing sections are arranged on a circular path, an envelope of the second bearing surface is designed to be circular cylindrical during operation of the rotor, i.e., during rotation about the axis of rotation. It is, furthermore, particularly preferred if the first bearing surface is designed to be circular cylindrical. In this way, the first and the second bearing surface for mounting the rotor can be received in circular cylindrical recesses of a pump housing.

Another advantageous design of the rotor provides that the rotor comprises a bore that is arranged concentrically to the axis of rotation and that ends on the front side in the first bearing surface, and that the guiding section comprises a vane shaft, wherein the bore is connected fluidically with the vane shaft. By providing a bore that is arranged concentrically to the axis of rotation and that is connected fluidically with the vane shaft, a supply of oil can be provided for lubricating a pump vane.

A particularly preferred development of the rotor provides that a metal insert that comprises a torque transmission section is positively inserted into the base body in the region of the first bearing surface. In this respect, it is particularly preferred if the plastic of the base body is injection molded around the insert. By providing the insert with the torque transmission section, a rotational movement of a drive unit, such as a belt drive or an electric motor, can be transmitted to the pump rotor.

In order to reliably transmit a rotational movement to the pump rotor, it is particularly preferred if the insert is arranged concentrically to the axis of rotation.

In order to positively connect the insert and the base body, it is advantageous if the insert is designed to be cylindrical and comprises a gear tooth system on its casing side. It is, furthermore, particularly preferred if the base body comprises a counter gear tooth system corresponding to the gear tooth system. Advantageously, this counter gear tooth system of the base body is produced by injection molding around the insert.

In a particularly advantageous embodiment of the rotor, the gear tooth system is designed to be dovetail-like, in such a way that the teeth of the gear tooth system expand radially outward. This dovetail-like expansion of the teeth of the gear tooth system is advantageous, since a spreading of the base body made of plastic during operation of the pump rotor can be avoided. Rather, the base body can be pulled onto the metallic insert.

It has been proven to be particularly advantageous if the insert is made of sintered steel, steel, or brass.

It is, furthermore, conceivable for the torque transmission section to be an internal hexagon or a dihedron. However, it is also conceivable to use other options for the torque transmission or other cross sections.

Additional details and advantageous developments of the invention are to be taken from the description below, by reference to which the embodiment illustrated in the figures is described and explained in more detail.

DETAILED DESCRIPTION

Figure 1:
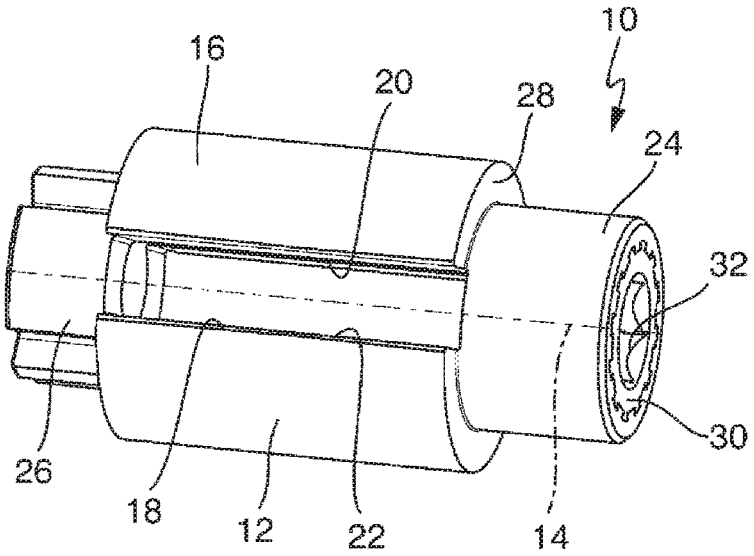
FIG. 1 is a diagonal view of a pump rotor according to the invention when looking at a first bearing surface.

FIG. 1 shows a pump rotor 10 for a vane cell pump—in particular, for a vacuum pump—not shown in the figures. In the figures, corresponding components and elements are designated by corresponding reference symbols. The pump rotor 10 comprises a base body 12 that is made of a plastic and that rotates about an axis of rotation 14 during operation. The base body 12 comprises a guiding section 16 with a vane shaft 18 for slidably receiving a pump vane. The vane shaft 18 is limited by two parallel planes 20, 22 that provide a guidance for the pump vane.

In the direction of the axis of rotation 14, the guiding section 16 is flanked by a first bearing surface 24 and a second bearing surface 26, wherein the guiding section 16 has a larger diameter than the first bearing surface 24, so that a shaft shoulder 28 is arranged between the first bearing surface 24 and the guiding section 16. The first bearing surface 24 is designed to be circular cylindrical. The first bearing surface 24 and the second bearing surface 26 are designed in such a way that they can be received in the circular cylindrical bearing receptacles of a pump housing not shown.

The base body 12 can be driven by rotation and comprises for this purpose in the region of the first bearing surface 24, a metal insert 30 that is made of a sintered metal or brass and that is arranged concentrically to the axis of rotation 14. The metallic insert 30 can be seen clearly in the exploded view according to FIG. 2. The insert 30 comprises a torque transmission section 32 in the shape of a hexagon, which can be seen clearly in FIGS. 5 and 6. By providing the torque transmission section 32, a rotational movement of a drive unit, such as a belt drive or an electric motor, can be transmitted to the pump rotor 10.

Figure 5:
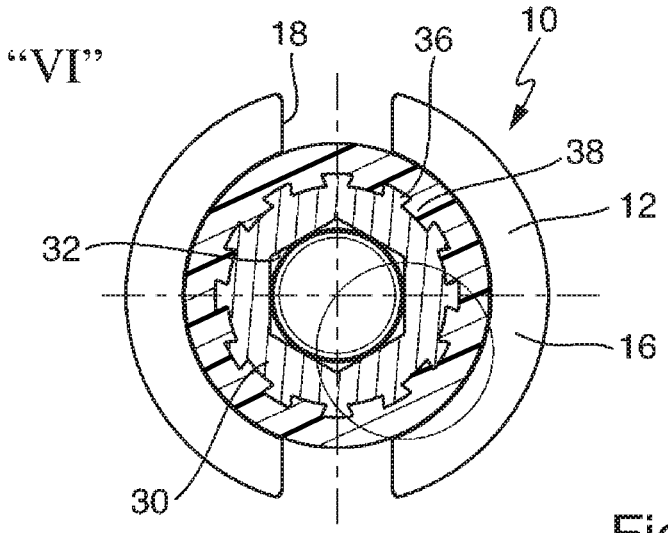
FIG. 5 is a section through the pump rotor according to FIGS. 1 through 3, orthogonal to the axis of rotation.
Figure 6:
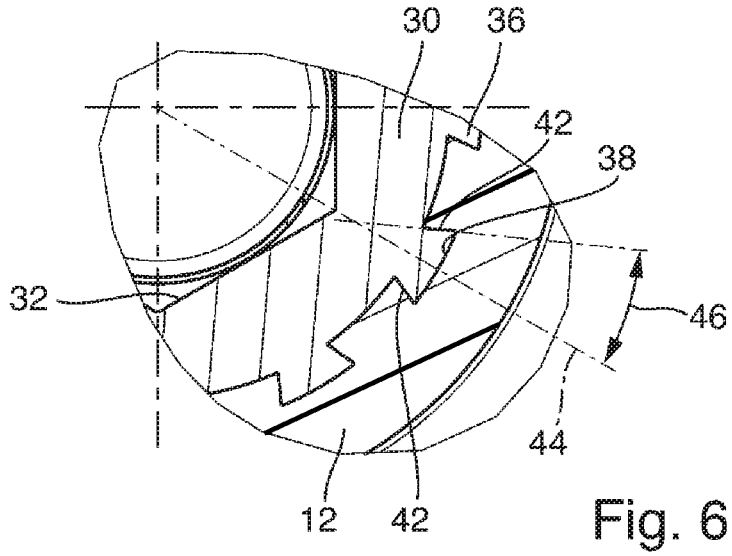
FIG. 6 is a detailed view VI of the section through the pump rotor according to FIG. 5.

In order to transmit the torque from the insert 30 to the base body 12, the insert 30 is positively inserted into the base body 12. In particular, the plastic of the base body is injection molded around the insert 30. For the torque transmission to the base body 12, the insert 30 comprises a gear tooth system 36 on its casing side 34, which can be clearly seen in FIGS. 3, 5, and 6. By the injection molding around the insert 30, the base body 12 comprises a counter gear tooth system 38 that corresponds to the gear tooth system 36 and that can also be seen clearly in the FIGS. 3, 5, and 6. FIG. 5 shows a section through the pump rotor 10 in a plane orthogonal to the axis of rotation 14 of the pump rotor 10, whereas FIG. 6 shows a detailed view VI of the section according to FIG. 5.

The gear tooth system 36 of the insert 30 is designed to be dovetail-like and comprises a multitude of teeth 40. In particular, the gear tooth system 36 is designed to be dovetail-like in such a way that the teeth 40 of the gear tooth system 36 expand radially outward, i.e., orthogonally to the axis of rotation 14. The flanks 42 of the teeth 40 enclose an angle 46 with a tooth center plane 44. This dovetail-like expansion of the teeth 40 is advantageous, since a spreading of the base body 12 made of plastic during operation of the pump rotor 10 can be avoided.

Figure 2:
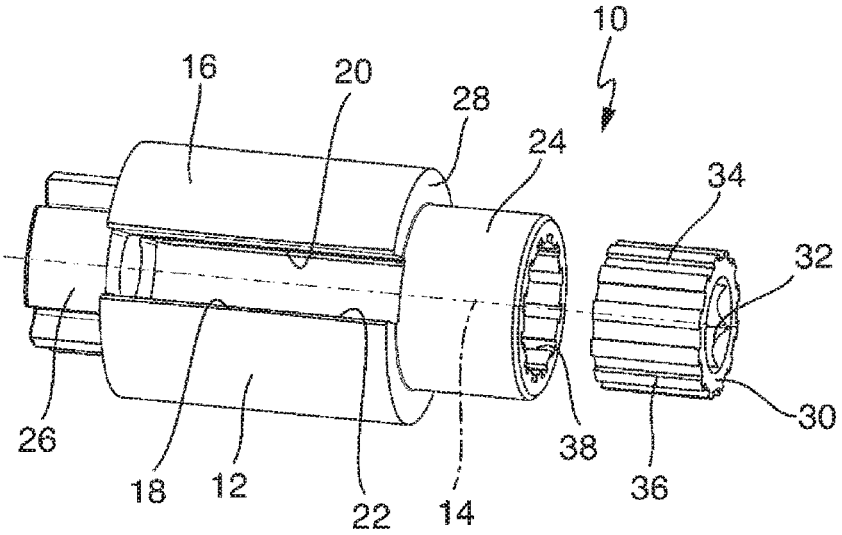
FIG. 2 is a diagonal view of a pump rotor according to FIG. 1 in an exploded view.
Figure 3:
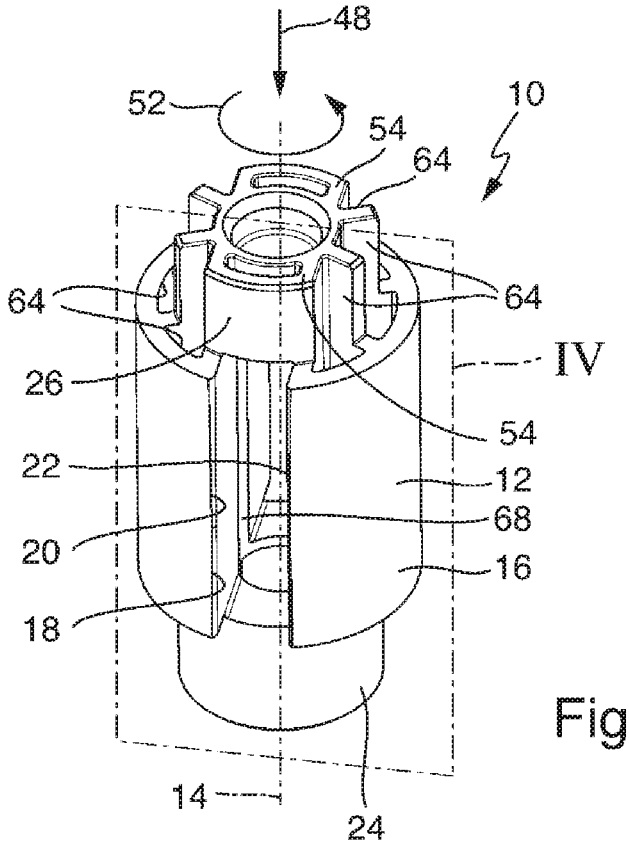
FIG. 3 is a diagonal view of the pump rotor according to FIGS. 1 and 2 when looking at a second bearing surface.

FIG. 3 shows a diagonal view of the pump rotor 10 according to FIGS. 1 and 2 when looking at a second bearing surface 26.

Figure 4:
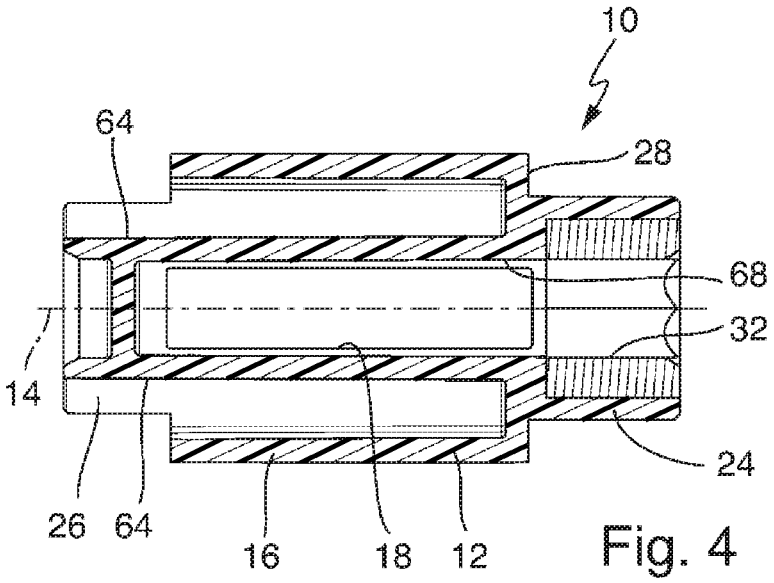
FIG. 4 is a section through the pump rotor according to FIGS. 1 through 3, through the plane IV according to FIG. 3.
Figure 7:
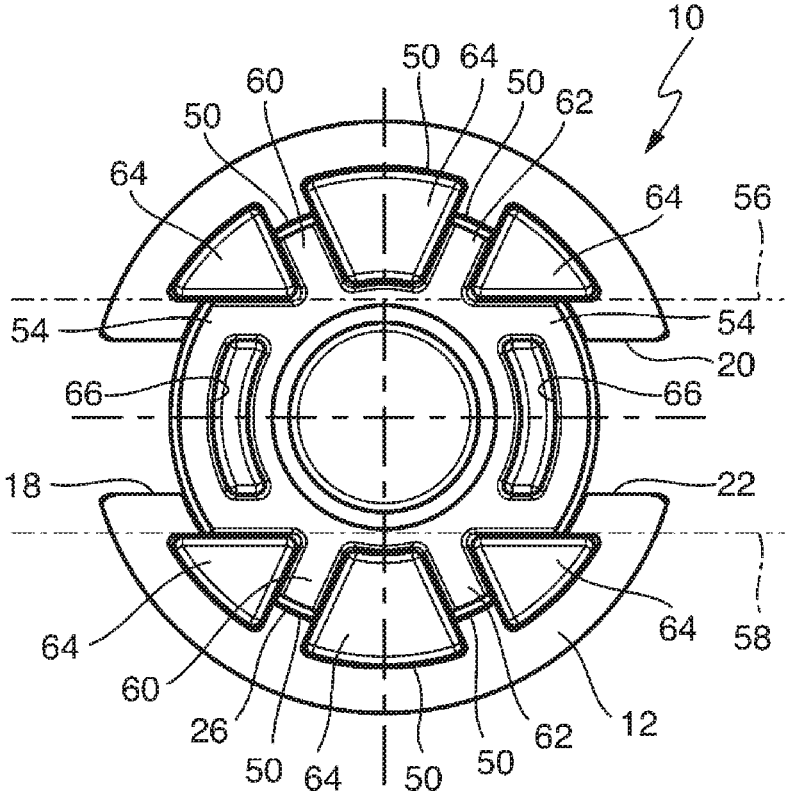
FIG. 7 is a lateral view of a pump rotor according to FIGS. 1 through 3, when looking at the second bearing surface.

FIG. 4 shows a section through the pump rotor 10 by the plane IV according to FIG. 3, whereas FIG. 7 shows a lateral view of the pump rotor 10 when looking at the second bearing surface 26 in the direction of the arrow 48 shown in FIG. 3.

As can be seen clearly in FIG. 7, the second bearing surface 26 comprises bearing sections 50 that are at a distance from one another and that lie on a circular path that is arranged concentrically to the axis of rotation 14. The second bearing surface 26 is designed to be cylindrical, as can be seen clearly in FIG. 3. If the pump rotor 10 rotates in the direction of the arrow 52 during operation, an envelope of the second bearing surface 26 is formed that is designed to be circular cylindrical.

The second bearing surface 26 comprises two circular arc sections 54 that are radially opposite each other and that each comprise a bearing section 50 radially at the outside. The circular arc sections 54 are limited by two planes 56, 58 arranged in parallel to the vane shaft 18 and by the bearing sections 50 arranged concentrically to the circular path. The circular arc sections 54 can be seen clearly in the view according to FIG. 7.

Between the circular arc sections 54, two bar sections 60, 62 each are arranged that also comprise a bearing section 50 at their free ends. By providing the bar sections 60, 62 arranged between the circular arc sections 54, a further radial guidance of the second bearing surface 26 is made possible, in addition to the bearing sections 50 of the circular arc sections 54.

The second bearing surface 26 with the circular arc sections 54 and the bar sections 60, 62 is consequently designed to be segmented, since the bearing sections 50 lying on the circular path are at a distance from one another.

This segmented design of the second bearing surface 26 has been proven to be particularly advantageous, since recesses 64 can be arranged in the base body 12 between the circular arc section 54 and the bar sections 60, 62.

As can be seen clearly in the section according to FIG. 4, the recesses 64 extend almost all the way to the shaft shoulder 28 in the area of the first bearing surface 24 and are designed to be nearly cylindrical, wherein mold release slopes not shown in the figures are provided that allow for the formation of an injection molding tool. In addition to the recesses 64, recesses 66 that, however, extend only through the first bearing surface 24 are still arranged in the circular arc sections 54 of the second bearing surface 26.

As a result of the recesses 64, 66, the base body 12 can be injection molded with largely constant wall thicknesses in the injection molding process, and a formation of blowholes can be extensively or nearly extensively avoided.

As can be seen clearly in the section according to FIG. 4, the pump rotor 10 comprises a blind hole 68 that is arranged concentrically to the axis of rotation 14, ends on the front side in the first bearing surface 24, and is connected with the vane shaft 18 fluidically in such a way that a supply of oil can be provided for lubricating a pump vane arranged slidably in the vane shaft 18.

The invention claimed is:

1. A rotor (10) for a vane cell pump with a base body (12) that is made of plastic and that rotates about an axis of rotation (14) during operation, wherein the base body (12) comprises a guiding section (16) for slidably receiving a pump vane and wherein the base body (12) is flanked in the direction of the axis of rotation (14) by a first bearing surface (24) and a second bearing surface (26), wherein the second bearing surface (26) comprises bearing sections (50) that are at a distance from one another and that lie on a circular path that is arranged concentrically to the axis of rotation (14), wherein the second bearing surface (26) comprises two circular arc sections (54) that are radially opposite each other, wherein each of the two circular arc sections (54) comprises one of the bearing sections (50) radially at an outside of the circular arc section (54), and wherein the second bearing surface (26) comprises between the circular arc sections (54) at least one bar section (60, 62), each bar section (60, 62) comprising another one of the bearing sections (50) at a free end of the bar section (60, 62).

2. The rotor (10) according to claim 1, wherein the base body (12) comprises recesses (64, 66) that start from the second bearing surface (26) and extend along the axis of rotation (14).

3. The rotor (10) according to claim 1, wherein the second bearing surface (26) is designed to be cylindrical.

4. The rotor (10) according to claim 1, wherein the rotor (10) comprises a bore (68) that is arranged concentrically to the axis of rotation (14) and that ends on the front side in the first bearing surface (24), and that the guiding section (16) comprises a vane shaft (18), wherein the bore (68) is connected fluidically with the vane shaft (18).

5. The rotor (10) according to claim 1, wherein a metallic insert (30) that comprises a torque transmission section (32) is positively inserted into the base body (12) in the region of the first bearing surface (24).

6. The rotor (10) according to claim 5, wherein the metallic insert (30) is arranged concentrically to the axis of rotation (14).

7. The rotor (10) according to claim 5, wherein the metallic insert (30) is designed to be cylindrical and comprises a gear tooth system (36) on its casing side (34).

8. The rotor (10) according to claim 7, wherein the gear tooth system (36) is designed to be dovetail-like in such a way that the teeth (40) of the gear tooth system (36) expand radially outward.

9. The rotor (10) according claim 5, wherein the metallic insert (30) is made of sintered steel, steel, or brass.

10. The rotor (10) according to claim 5, wherein the torque transmission section (32) is an internal hexagon or a dihedron.

11. A vane cell pump comprising a rotor (10) according to claim 1.

12. The vane cell pump according to claim 11, wherein the vane cell pump is a vacuum pump.

13. The rotor (10) for a vane cell pump according to claim 1, wherein the vane cell pump is a vacuum pump.

14. The rotor (10) for a vane cell pump according to claim 1, wherein the at least one bar section (60, 62) between the circular arc sections (54) comprises two bar sections (60, 62).

* * * * *